US009259073B2

(12) United States Patent
Chen

(10) Patent No.: US 9,259,073 B2
(45) Date of Patent: Feb. 16, 2016

(54) COSMETIC APPLICATOR

(71) Applicant: Capicolor International Cosmetics Ltd., Taichung (TW)

(72) Inventor: Ming-Hung Chen, Taichung (TW)

(73) Assignee: CAPICOLOR INTERNATIONAL COSMETICS LTD., Taichung (TW)

( * ) Notice: Subject to any disclaimer, the term of this patent is extended or adjusted under 35 U.S.C. 154(b) by 197 days.

(21) Appl. No.: 14/066,473

(22) Filed: Oct. 29, 2013

(65) Prior Publication Data

US 2015/0117933 A1 Apr. 30, 2015

(51) Int. Cl.

| | |
|---|---|
| ***A47L 13/22*** | (2006.01) |
| ***A45D 34/04*** | (2006.01) |
| *A45D 34/00* | (2006.01) |

(52) U.S. Cl.

CPC ..... *A45D 34/042* (2013.01); *A45D 2034/005* (2013.01)

(58) Field of Classification Search

CPC ..... A45D 34/041; B43K 8/06; B43K 8/08
USPC ..... 401/223–227, 199, 276, 283
See application file for complete search history.

(56) References Cited

U.S. PATENT DOCUMENTS

| | | | | |
|---|---|---|---|---|
| 5,551,789 | A * | 9/1996 | Okawa et al. | 401/199 |
| 6,276,860 | B1 * | 8/2001 | Nakajima et al. | 401/199 |
| 6,619,870 | B2 * | 9/2003 | Furukawa et al. | 401/224 |
| 6,619,871 | B2 * | 9/2003 | Furukawa et al. | 401/224 |

* cited by examiner

*Primary Examiner* — Jennifer C Chiang
(74) *Attorney, Agent, or Firm* — Christensen O'Connor Johnson Kindness PLLC

(57) ABSTRACT

A cosmetic applicator includes: a seat that has a ventilation channel extending through an outer surface; an adjusting member that is disposed in a sleeve and that has several adjusting plates, an axial hole, and a gap formed in the adjusting plates and communicating the hole with the ventilation channel; and a core that extends through the hole, absorbs liquid cosmetic from a cartridge and defines a communicating channel with the adjusting member. The ventilation channel, the gap and the communicating channel define an air passage. The cartridge, the core and a bristle member define a liquid passage. Air is introduced into the cartridge through the air passage after the liquid cosmetic flows out of the cartridge through the liquid passage.

4 Claims, 11 Drawing Sheets

COSMETIC APPLICATOR

BACKGROUND OF THE INVENTION

1. Field of the Invention

The invention relates to a cosmetic product, more particularly to a cosmetic applicator with an application mechanism for allowing automatic and smooth flow of liquid cosmetic.

2. Description of the Related Art

Referring to FIG. 1, a conventional cosmetic applicator 10 (such as eyeliner) includes a casing 11, an adjusting member 12, a cartridge 13, a core 14, a seat 15 and a brush 16. The cartridge 13 is disposed on a rear end section of the adjusting member 12 and contains liquid cosmetic. The adjusting member 12 defines an axial hole 121 for insertion of the core 14. The core 14 has a rear end extending rearward toward the cartridge 13 for absorbing the liquid cosmetic therein. A plurality of adjusting plates 122 are provided on an outer surface of the adjusting member 12, and a side of each adjusting plate 122 is in spatial communication with the axial hole 121 such that liquid cosmetic absorbed by the core 14 can spread to the adjusting plates 122 for storage and water regulation. The seat 15 is sleeved onto a front end of the adjusting member 12 with at least one opening 151 formed in an outer side thereof. The outer side of the seat 15 and the adjusting member 12 cooperatively define a passage 152. Air flows into the passage 152 via the opening 151, the core 14 and reaches the adjusting plates 122 of the adjusting member 12. The brush 16 is disposed in the seat 15 and has a front end protruding therefrom, and a rear end connected to the core 14. The liquid cosmetic flows out the brush 16 after being absorbed by core 14.

Although the aforementioned conventional cosmetic applicator 10 has an automatic liquid cosmetic flow effect, there is still room for improvement. During use, when the liquid cosmetic passes through the core 14 to exit through the brush 16, negative pressure is produced within the adjusting member 12. At this time, air outside the conventional cosmetic applicator 10 enters the passage 152 through the opening 151, passes through the core 14 and reaches the adjusting plates 122 of the adjusting member 12 to balance the negative pressure. However, air and the liquid cosmetic share the core 14 as a common passage such that air entering and the liquid cosmetic exiting the conventional cosmetic applicator 10 interfere with each other. This causes inconsistent liquid cosmetic flow out of the brush 16. In addition, when the adjusting plates 122 have stored a large amount of the liquid cosmetic, the liquid cosmetic will flow along the passage 152 and leak out from the opening 151.

SUMMARY OF THE INVENTION

Therefore, the object of the present invention is to provide a cosmetic applicator that can eliminate the aforesaid drawbacks of the prior art.

According to the present invention, there is provided a cosmetic applicator including a casing, a cartridge and an application mechanism.

The cartridge is disposed in the casing and contains liquid cosmetic. The application mechanism includes a sleeve, a seat, an adjusting member, a core and a bristle member.

The sleeve is coupled to a front end of the casing. The seat has a rear segment that is inserted into a front end of the sleeve, a front segment that extends outwardly from the sleeve, a ventilation channel that extends through outer surfaces of the front and rear segments, and an air inlet that is formed in the front segment for communicating the ventilation channel with the external environment.

The adjusting member is disposed in the sleeve and has a main body, a plurality of adjusting plates connected to the main body and spaced apart from each other in a front-rear direction, a first end portion extending from a front end of the main body and connected to the seat, and a second end portion extending from a rear end of the main body and connected to the cartridge. The adjusting member further has an axial hole that extends through the first end portion, the main body and the second end portion, and a gap that is formed in the adjusting plates and the main body, and that communicates the axial hole with the ventilation channel. The axial hole has a portion that corresponds to the second end portion of the adjusting member and that has a diameter greater than that of another portion that corresponds to the main body.

The core extends through the axial hole and has a rear end that is connected to the cartridge for absorbing the liquid cosmetic, and that cooperates with the second end portion of the adjusting member to define a communicating channel therebetween. The ventilation channel, the gap and the communicating channel cooperatively define an air passage. The bristle member is disposed in the seat and has a rear end that is connected to a front end of the core, and a front end that protrudes out of the seat. The cartridge, the core and the bristle member cooperatively define a liquid passage. Air is introduced into the cartridge through the air passage after the liquid cosmetic flows out of the cartridge through the liquid passage, thereby balancing the pressure inside the cartridge and ensuring a smooth application of the liquid cosmetic.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
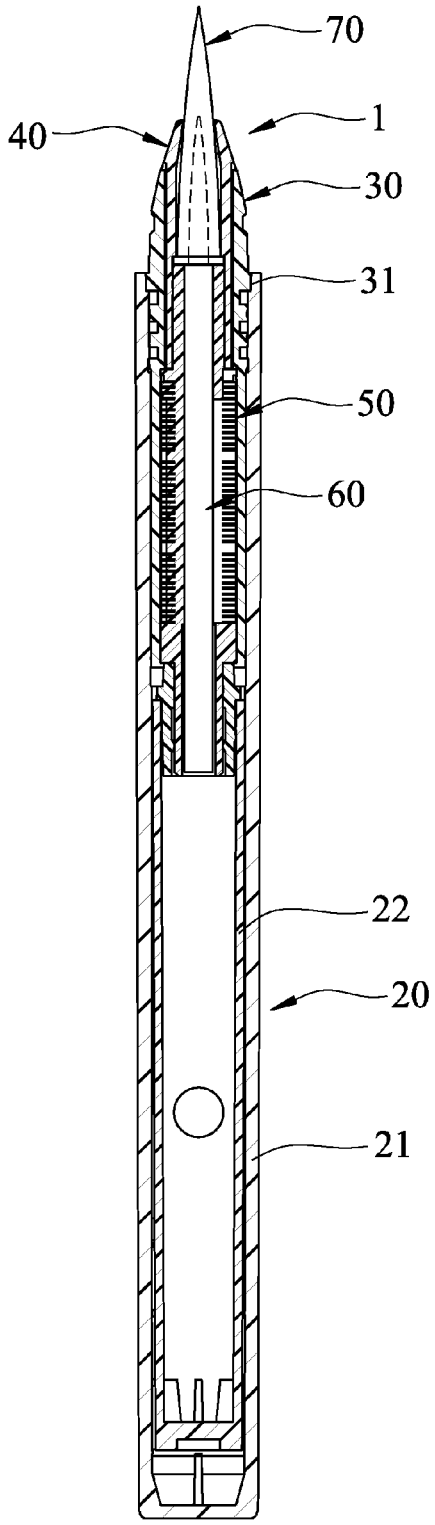
FIG. 2 is a sectional view of a cosmetic applicator according to the preferred embodiment of the present invention.
Figure 3:
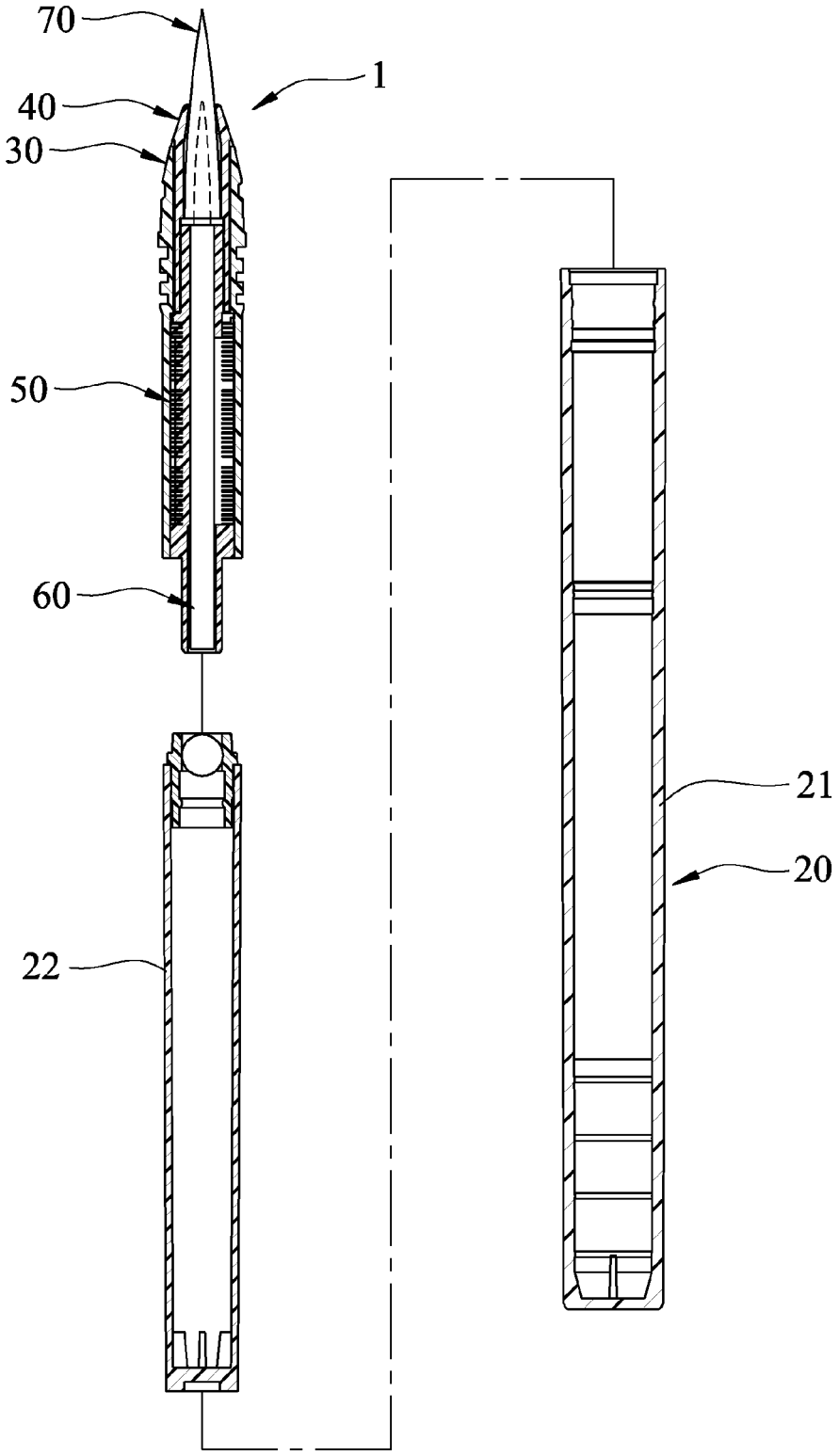
FIG. 3 is a partly exploded sectional view of the preferred embodiment.

Referring to FIGS. 2 and 3, the preferred embodiment of a cosmetic applicator 20 according to the present invention includes a casing 21, a cartridge 22 disposed in the casing 21 and containing liquid cosmetic, and an application mechanism 1 disposed in a front end section of the casing 21 and having a rear end section connected to the cartridge 22 and a front end section protruding out of the casing 21.

Figure 4:
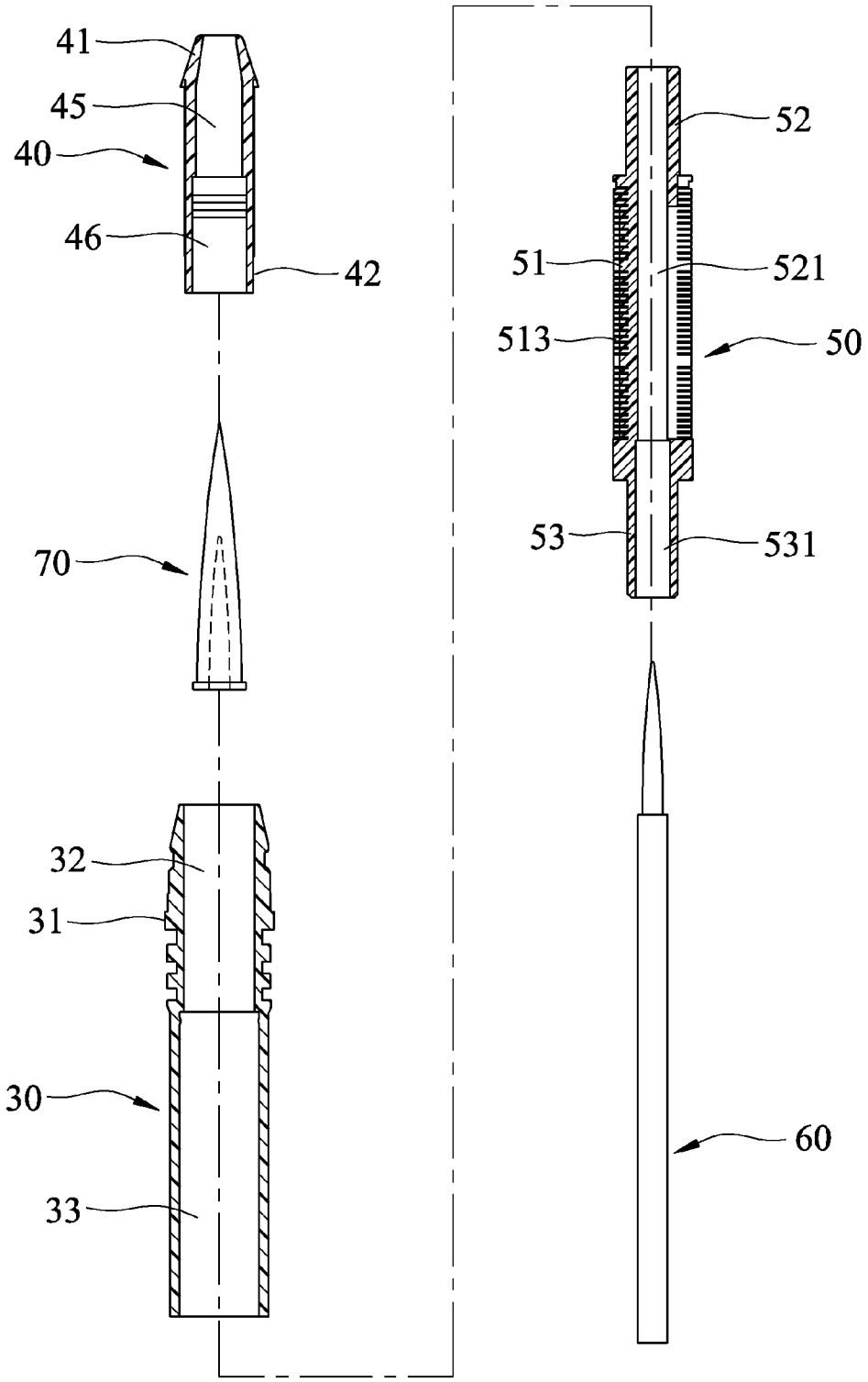
FIG. 4 is a fragmentary exploded sectional view of the preferred embodiment for illustrating an application mechanism.

With further reference to FIG. 4, the application mechanism 1 includes a sleeve 30, a seat 40, an adjusting member 50, a core 60 and a bristle member 70.

Figure 5:
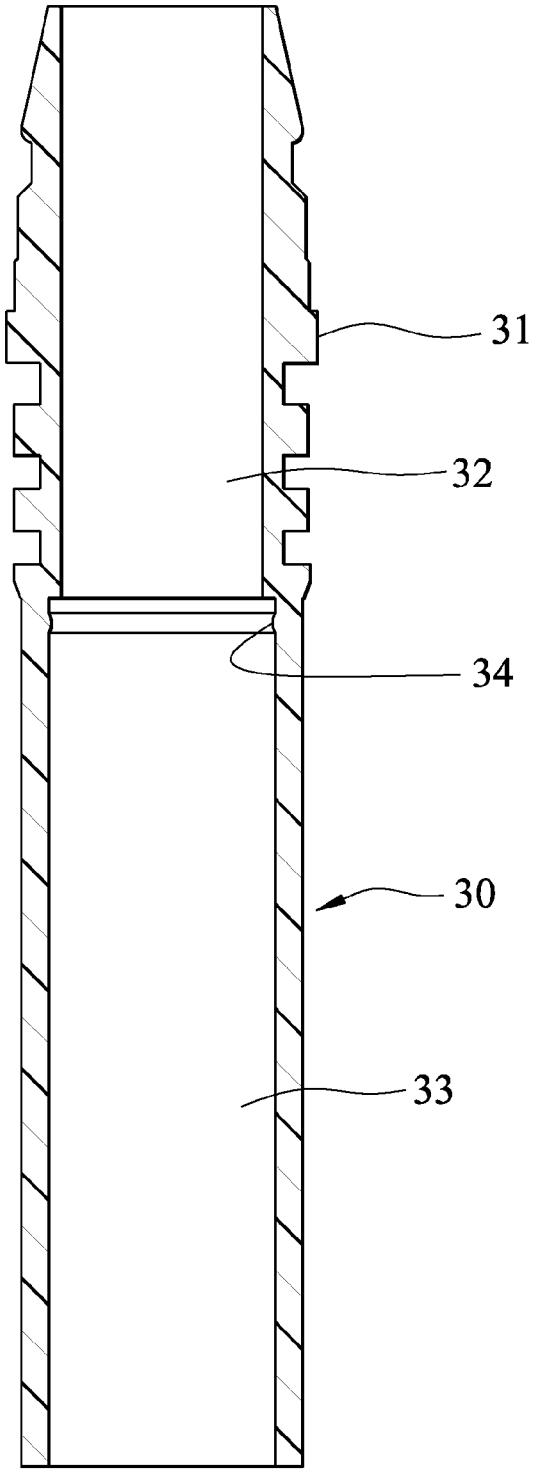
FIG. 5 is a sectional view of a sleeve of the application mechanism.

Also referring to FIG. 5, the sleeve 30 is coupled to the front end section of the casing 21, and has an outer surface provided with a connecting portion 31 for sleevingly connecting to an inner surface of the casing 21, and an inner surface that defines a front hole 32 and a rear hole 33. A front section of the inner surface of the rear hole 33 is formed with a positioning protrusion 34.

Figure 6:
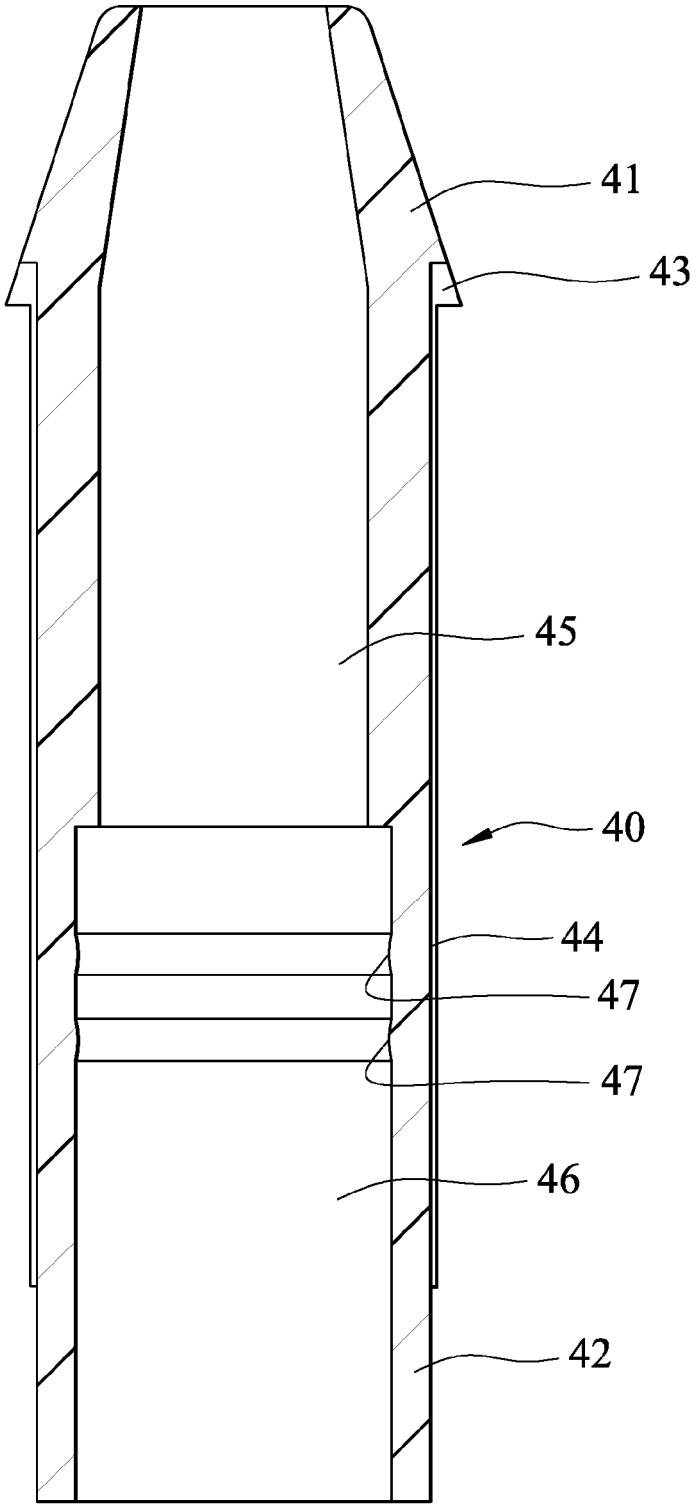
FIG. 6 is a sectional view of a seat of the application mechanism.
Figure 7:
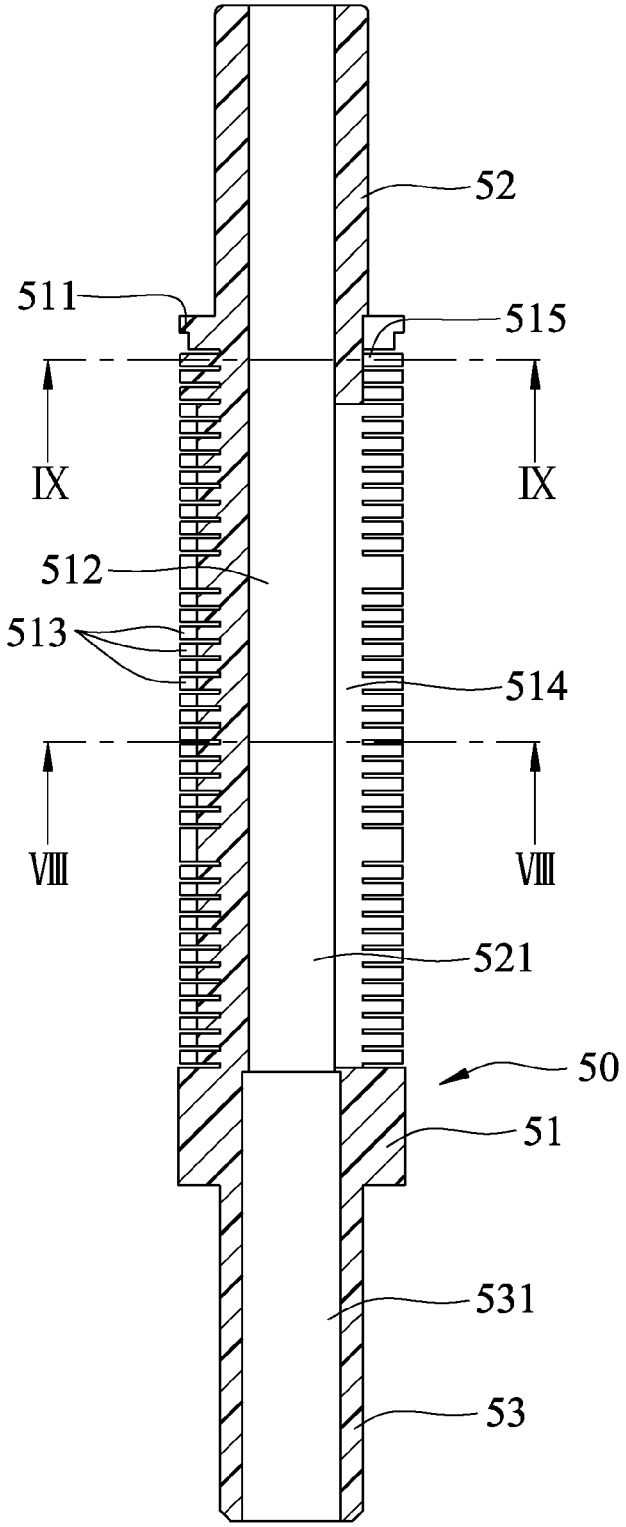
FIG. 7 is a sectional view of an adjusting member of the application mechanism.

Also referring to FIG. 6, the seat 40 is sleevingly connected to the sleeve 30, and has a front segment 41, a rear segment 42, an air inlet 43 and a ventilation channel 44. The front segment 41 extends outwardly of the sleeve 30 and the rear segment 42 is inserted into a front end of the sleeve 30. The ventilation channel 44 extends through outer surfaces of the front and rear segments 41, 42. The air inlet 43 is formed in the front segment 41 for communicating the ventilation channel 44 with the external environment. In this embodiment, there is a plurality of air inlets 43 and a plurality of ventilation channels 44. Each of the air inlets 43 communicates with a respective ventilation channel 44. Air enters the air inlet 43, flows through the ventilation channel 44 and into the rear hole 33 of the sleeve 30. The seat 40 has an inner surface that defines a first receiving hole 45 and a second receiving hole 46.

Figure 1:
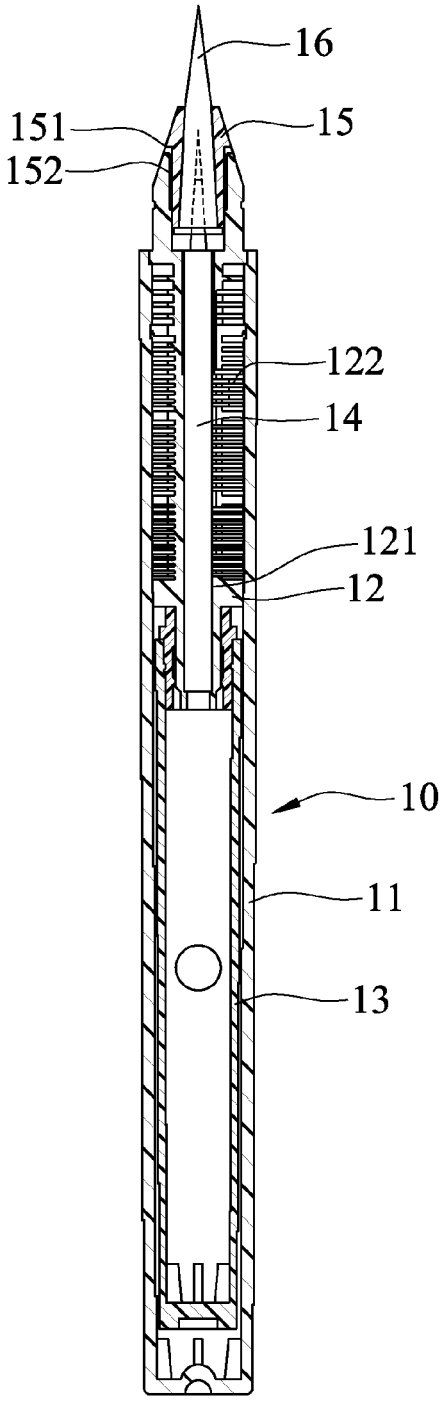
FIG.1 PRIOR ART
FIG. 1 is a sectional view of a conventional cosmetic applicator.

Also referring to FIG. 1, the adjusting member 50 is disposed in the sleeve 30 and has a main body 51, a plurality of adjusting plates 513, a first end portion 52 and a second end portion 53. The main body 51 is disposed in the rear hole 33 of the sleeve 30. The adjusting plates 513 are connected to an outer surface of the main body 51 and spaced apart from each other in a front-rear direction. The first end portion 52 extends from a front end of the main body 51 and is connected to the seat 40. The second end portion 53 extends from a rear end of the main body 51 and is inserted into and connected to the cartridge 22. One of the inner surface of the sleeve 30 and an outer surface of the first end portion 52 of the adjusting member 50 is provided with a positioning recess 511, and the other one of the inner surface of the sleeve 30 and the outer surface of the first end portion 52 is provided with a positioning protrusion 34 engaging the positioning recess 511 for locking the adjusting member 50 to the sleeve 30.

Figure 8:
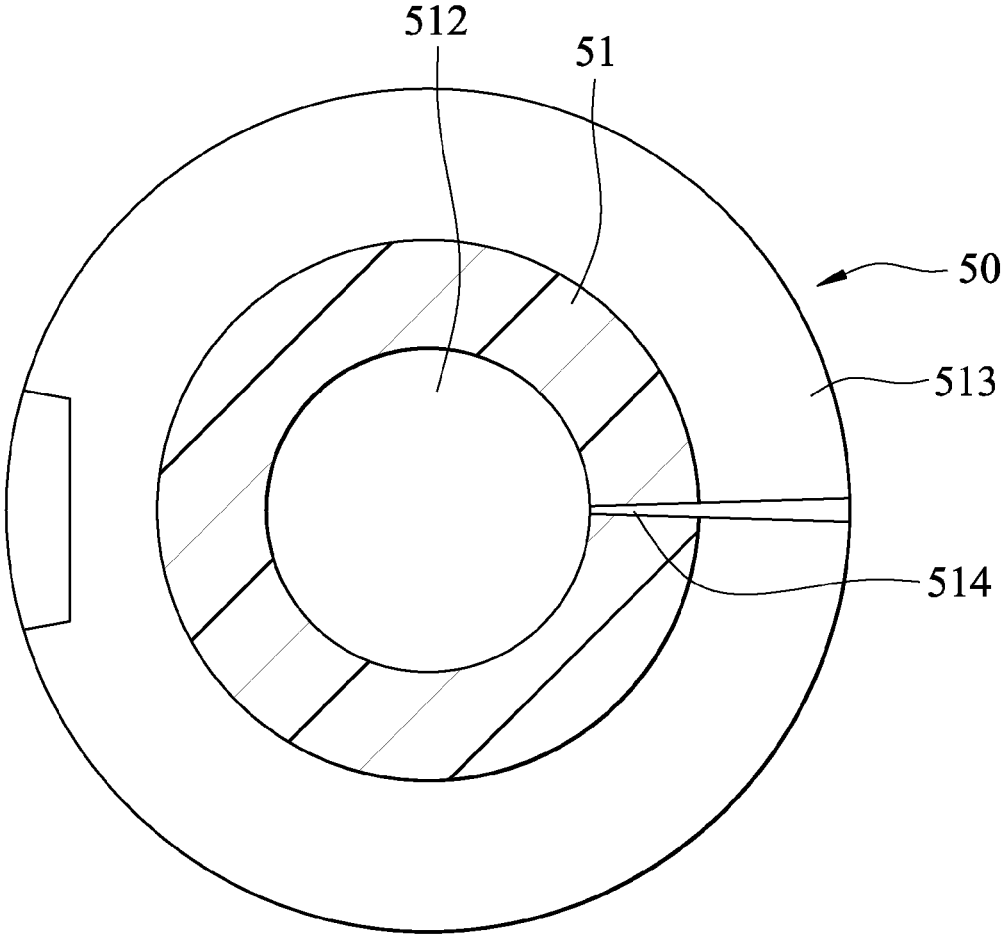
FIG. 8 is a sectional side view of the adjusting member taken along line VIII-VIII of FIG. 7.
Figure 9:
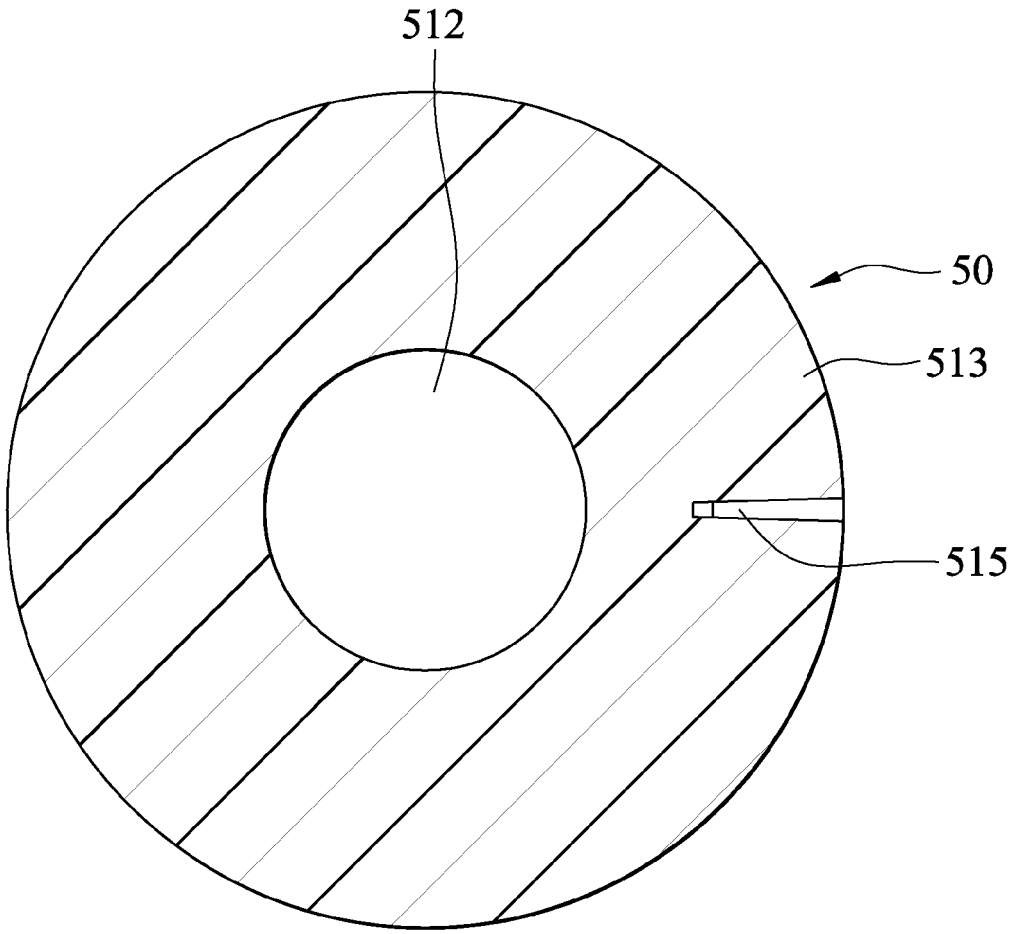
FIG. 9 is another sectional side view of the adjusting member taken along line IX-IX of FIG. 7.

The adjusting member 50 further has an axial hole 512 that extends through the first end portion 52, the main body 51 and the second end portion 53, and a gap 514 that is formed in an outer periphery of the adjusting plates 513 and the main body 51 (shown in FIG. 8), and that communicates the axial hole 512 with the ventilation channel 44. The axial hole 512 has a portion 531 that corresponds to the second end portion 53 of the adjusting member 50, and that has a diameter greater than that of another portion 521 that corresponds to the main body 51. Further referring to FIG. 9, the main body 51 of the adjusting member 50 further has an opening 515 formed in a front end of the adjusting member 50 (i.e., the frontmost adjusting plate 513) for communicating the gap 514 with the ventilation channel 44 such that air entering the seat 40 can reach the adjusting plates 513 through the opening 515.

The first end portion 52 of the adjusting member 50 is inserted into the second receiving hole 46 of the seat 40. One of the inner surface of the seat 40 and an outer surface of the first end portion 52 is provided with at least one projection 47 (two in this embodiment) that abuts airtightly against the other one of the inner surface of the seat 40 and the outer surface of the first end portion 52 of the adjusting member 50.

The core 60 is disposed in and extends through the axial hole 512 of the adjusting member 50 and has a rear end that is connected to the cartridge 22 for absorbing the liquid cosmetic and that cooperates with the second end portion 53 of the adjusting member 50 to define a communicating channel 8 (see FIG. 10) therebetween, and a front end that protrudes out of the first end portion 52 and extends into the seat 40. In this embodiment, the core 60 is made of cotton.

The bristle member 70 is disposed in the first receiving hole 45 of the seat 40 and has a rear end that is connected to a front end of the core 60 for the liquid cosmetic to flow into the bristle member 70, and a front end that protrudes out of the seat 40.

Figure 10:
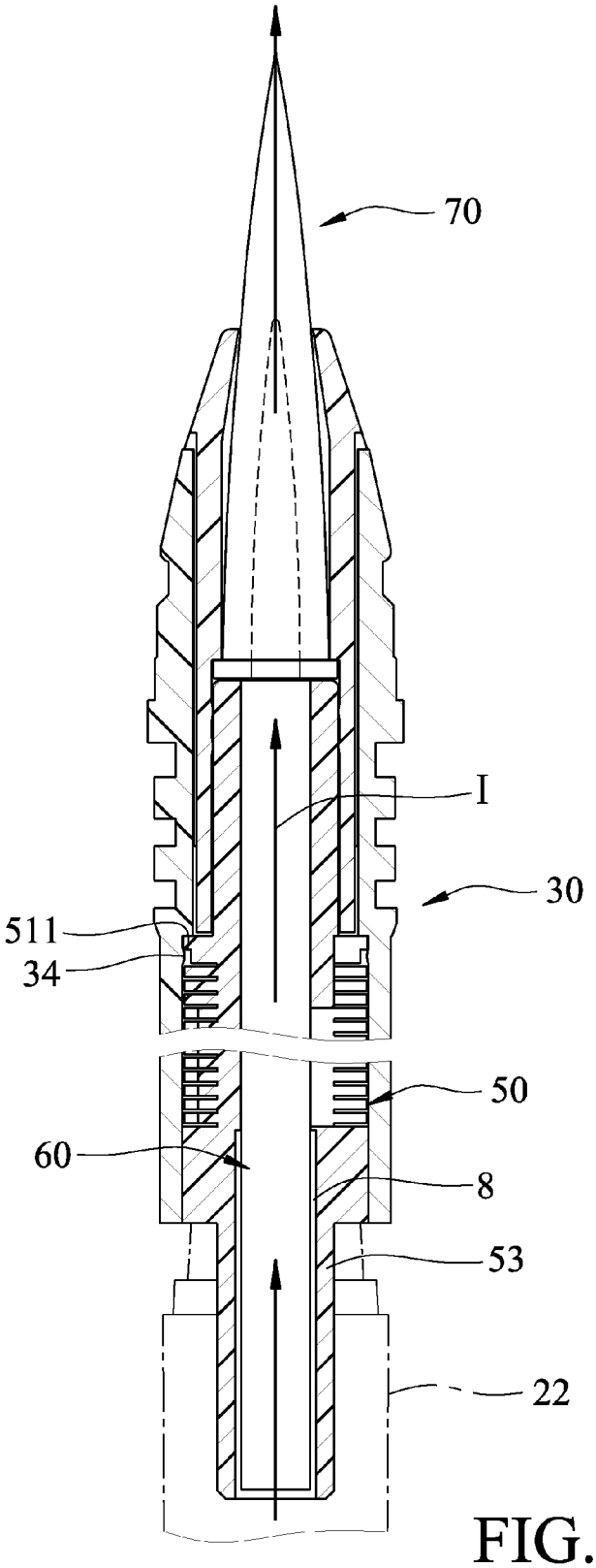
FIG. 10 is a fragmentary sectional view of the preferred embodiment for illustrating a liquid passage and flow direction of the liquid cosmetic therein.

Operational details of the abovementioned invention are as follows:

Referring to FIG. 10, according to the present invention, the cartridge 22, the core 60 and the bristle member 70 cooperatively define a liquid passage (I). When in use, once the liquid cosmetic in the cartridge 22 is absorbed by the core 60, the liquid cosmetic will flow through the liquid passage (I) until reaching and exiting the bristle member 70.

Figure 11:
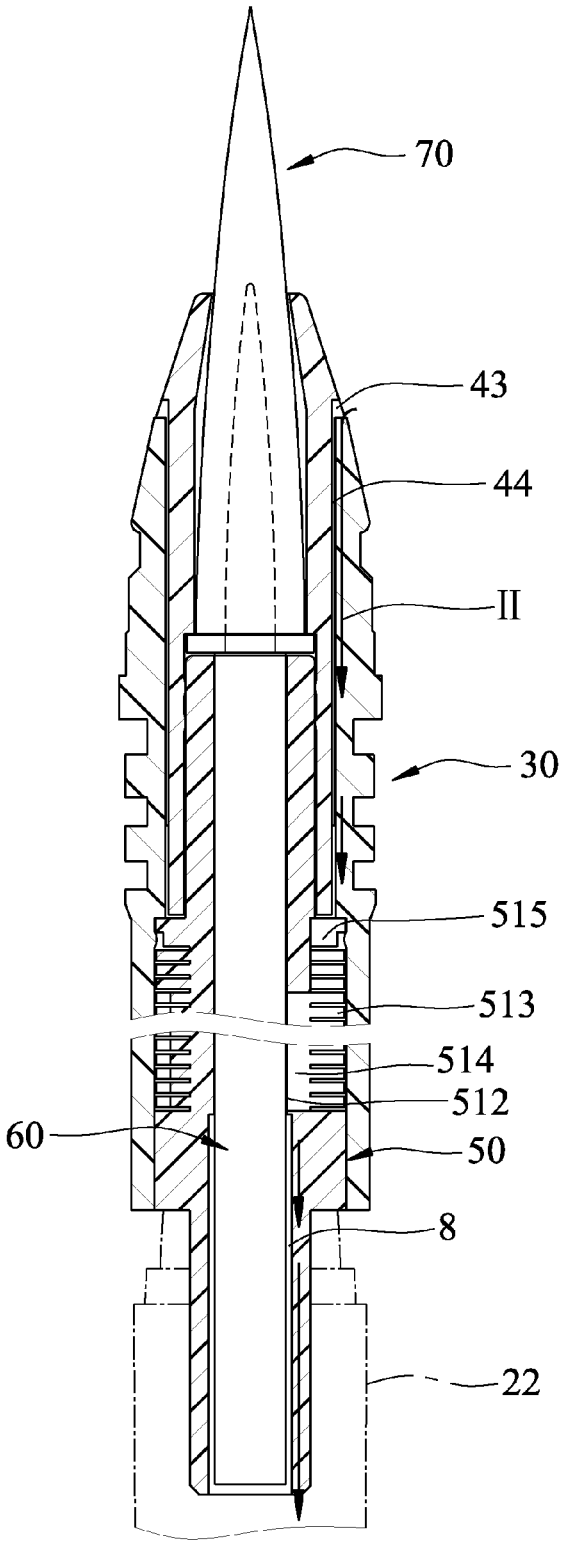
FIG. 11 is another fragmentary sectional view of the preferred embodiment for illustrating an air passage and flow direction of air therein.

Referring to FIG. 11, the ventilation channel 44, the opening 515, the gap 514 and the communicating channel 8 cooperatively define an air passage (II). When the liquid cosmetic exits through the bristle member 70, the amount of liquid cosmetic in the cartridge 22 is reduced, thus creating negative pressure. At this time, air enters the seat 40 through the air inlet 43, passes through the air channel (II) and into the cartridge 22 for canceling the negative pressure and maintaining pressure balance such that liquid cosmetic can flow smoothly and consistently out of the bristle member 70.

In summary, air is introduced into the cartridge 22 through the air passage (II) when the liquid cosmetic flows out of the bristle member 70 through the liquid passage (I), thereby ensuring a smooth application of the liquid cosmetic. In addition, the air and the liquid cosmetic no longer share the same passage and interfere with each other, thereby not only ensuring the smooth and consistent application of the liquid cosmetic but also by nature of the separate passage design, leakage of the liquid cosmetic is prevented.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A cosmetic applicator comprising:

a casing;

a cartridge that is disposed in said casing and that contains liquid cosmetic; and an application mechanism that includes a sleeve coupled to a front end of said casing, and a seat having a rear segment that is inserted into a front end of said sleeve, a front segment that extends outwardly of said sleeve, a ventilation channel that extends through outer surfaces of said front and rear segments, and an air inlet that is formed in said front segment for communicating said ventilation channel with the external environment;

an adjusting member disposed in said sleeve and having a main body, a plurality of adjusting plates connected to said main body and spaced apart from each other in a front-rear direction, a first end portion extending from a front end of said main body and connected to said seat, and a second end portion extending from a rear end of said main body and connected to said cartridge, said adjusting member further having an axial hole that extends through said first end portion, said main body and said second end portion, and a gap that is formed in said adjusting plates and said main body, and that communicates said axial hole with said ventilation channel, said axial hole having a portion that corresponds to said second end portion of the adjusting member and that has a diameter greater than that of another portion that corresponds to said main body;

a core extending through said axial hole and having a rear end that is connected to said cartridge for absorbing the liquid cosmetic, and that cooperates with said second end portion of said adjusting member to define a communicating channel therebetween, said ventilation channel, said gap and said communicating channel cooperatively defining an air passage; and a bristle member disposed in said seat and having a rear end that is connected to a front end of said core, and a front end that protrudes out of said seat, said cartridge, said core and said bristle member cooperatively defining a liquid passage;

wherein air is introduced into said cartridge through said air passage when the liquid cosmetic flows out of said cartridge through said liquid passage, thereby balancing the pressure inside said cartridge and ensuring a smooth application of the liquid cosmetic.

2. The cosmetic applicator as claimed in claim in 1, wherein said seat has an inner surface that defines a receiving hole, said first end portion of said adjusting member being inserted into said receiving hole, one of said inner surface of said seat and an outer surface of said first end portion of said adjusting member being provided with at least one projection that abuts airtightly against the other one of said inner surface of said seat and said outer surface of said first end portion of said adjusting member.

3. The cosmetic applicator as claimed in claim 1, wherein said sleeve has an inner surface that defines a rear hole, one of said inner surface of said sleeve and an outer surface of said first end portion of said adjusting member being provided with a positioning recess, the other one of said inner surface of said rear hole and said outer surface of said first end portion of said adjusting member being provided with a positioning protrusion engaging said positioning recess for locking said adjusting member to said sleeve.

4. The cosmetic applicator as claimed in claim 1, wherein said adjusting member further has an opening formed in a front end of said adjusting member for communicating said gap with said ventilation channel, and the air passage is cooperatively defined by said ventilation channel, said opening, said gap and said communicating channel.

* * * * *